United States Patent [19]

Maisch

[11] Patent Number: 4,671,246

[45] Date of Patent: Jun. 9, 1987

[54] APPARATUS FOR CONTROLLING RECIRCULATED QUANTITIES OF EXHAUST GAS IN INTERNAL COMBUSTION ENGINES

[75] Inventor: Wolfgang Maisch, Schwieberdingen, Fed. Rep. of Germany

[73] Assignee: Robert Bosch GmbH, Stuttgart, Fed. Rep. of Germany

[21] Appl. No.: 870,570

[22] Filed: Jun. 4, 1986

[30] Foreign Application Priority Data

Jul. 23, 1985 [DE] Fed. Rep. of Germany ..... 3526279

[51] Int. Cl.[4] ..... F02M 25/06

[52] U.S. Cl. ..... 123/571; 123/568

[58] Field of Search ..... 123/511, 568, 569, 571, 123/585, 587; 137/115, 116, 510, DIG. 8

[56] References Cited

U.S. PATENT DOCUMENTS

| | | | |
|---|---|---|---|
| 4,009,700 | 3/1977 | Engels et al. | 123/571 X |
| 4,150,648 | 4/1979 | Ogita | 123/568 |
| 4,177,777 | 12/1979 | Maruyama et al. | 123/571 |
| 4,271,811 | 6/1981 | Suzuki et al. | 123/571 |
| 4,353,385 | 10/1982 | Maisch et al. | 123/511 X |
| 4,367,720 | 1/1983 | Miyoshi et al. | 123/571 |
| 4,466,416 | 8/1984 | Kawamura | 123/571 |
| 4,467,775 | 8/1984 | Buck et al. | 123/571 |
| 4,495,922 | 1/1985 | Fujimura et al. | 123/440 |
| 4,620,520 | 11/1986 | Maisch et al. | 123/571 |

*Primary Examiner*—Willis R. Wolfe, Jr.

*Attorney, Agent, or Firm*—Edwin E. Greigg

[57] ABSTRACT

An apparatus is proposed which serves to control the quantity of exhaust gas recirculated from the exhaust gas system of an internal combustion engine to its intake side. The apparatus includes a pneumatic control element having a diaphragm, which defines a work chamber and actuates a valve closing member of an exhaust gas recirculation valve. Via a control pressure line, the work chamber communicates with a flow line leading to the atmosphere and a connecting line leading to the intake tube downstream of a throttle valve. A check valve opening toward the intake tube, a reservoir and a throttle restriction are disposed in the connecting line. A bypass line having a bypass valve embodied as an electrofluid converter control of the nozzle/impact plate type bypasses the throttle restriction. In the flow line is a regulating valve, also embodied as an electrofluid converter of the nozzle/impact plate type, by means of which, triggered by an electronic control unit as a function of engine operating chracteristics, a predetermined pressure drop can be established between the atmosphere and the pressure in the work chamber.

4 Claims, 1 Drawing Figure

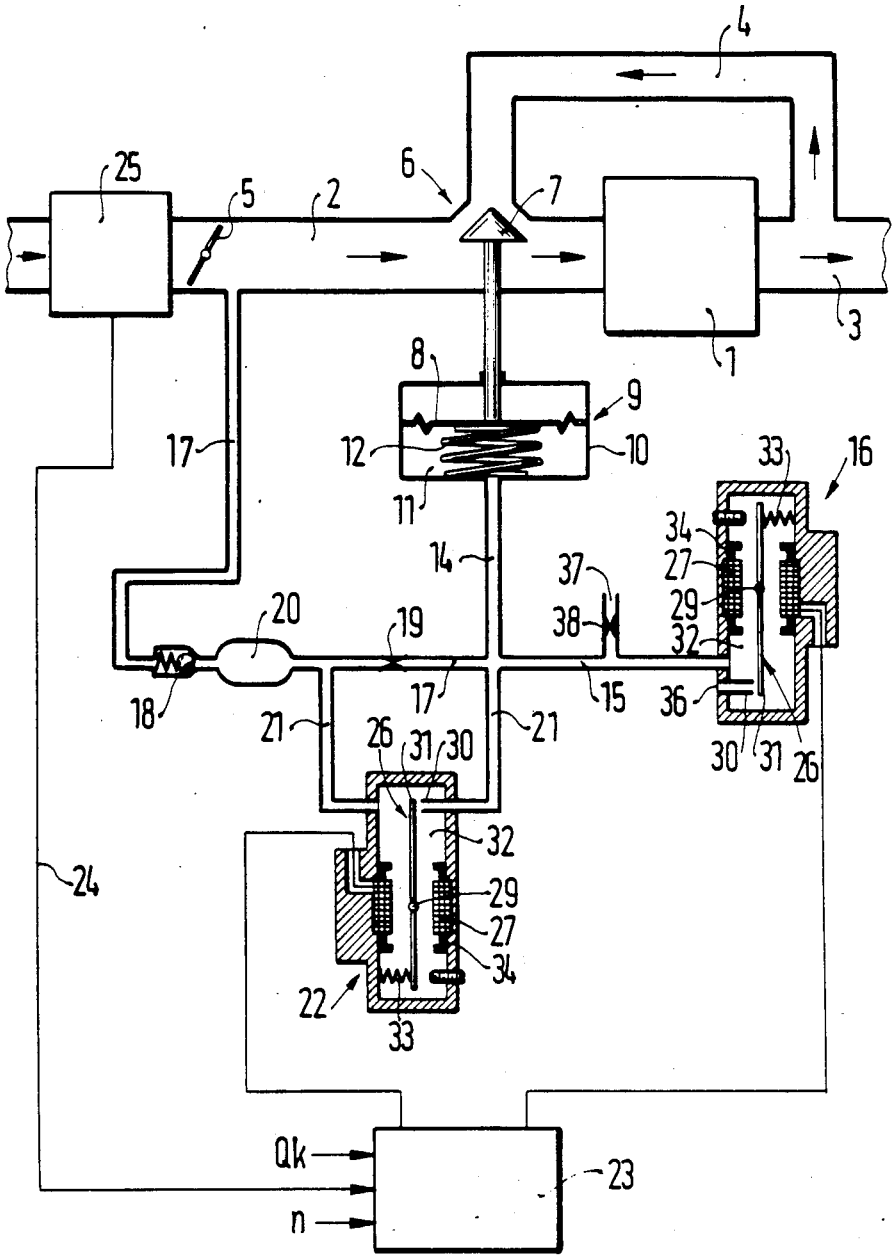
4
25
5
2
6
7
3
1
8
9
17
12
10
11
33
16
34
27
29
32
14
37
38
20
19
18
17
15
36
21
26
31
30
21
30
31
26
32
24
29
27
34
22
33
Qk
23
n

APPARATUS FOR CONTROLLING RECIRCULATED QUANTITIES OF EXHAUST GAS IN INTERNAL COMBUSTION ENGINES

BACKGROUND OF THE INVENTION

The invention is based on an apparatus for controlling recirculated quantities of exhaust gas as generally defined hereinafter. An apparatus for controlling recirculated quantities of exhaust gas is already known (U.S. Pat. No. 4,177,777), in which the control pressure is formed with the aid of a magnetic valve that controls communication with the ambient air, so that the control pressure of a pneumatically actuated exhaust gas recirculation (EGR) valve is varied, thereby controlling the magnitude of the recirculated exhaust gas quantity. This has the disadvantage, however that if the opening cross section of the magnetic valve remains unchanged, the pressure prevailing in the work chamber of the pneumatic control element of the EGR valve varies when there is a change in the difference between atmospheric pressure and the pressure in the intake tube downstream of the throttle valve, resulting in undesirable changes in the exhaust gas recirculation rate.

OBJECT AND SUMMARY OF THE INVENTION

The apparatus according to the present invention has the advantage over the prior art that the exhaust gas recirculation rate is controlled more accurately and rapidly, with a simpler and less expensive design of the triggering electronics. By using two electrofluid converters of the nozzle/impact plate type, equally fast adjusting speeds are attainable in both adjusting directions of the control element. A small cross section of the throttle restriction can accordingly be selected as well, thereby attaining fast triggering of the pneumatic control element and hence a rapid decrease or increase in the exhaust gas recirculation rate when there is a sudden actuation of the throttle valve.

In a particularly advantageous embodiment of the invention as defined hereinafter, a sufficient pressure difference is still available for triggering the pneumatic control element for a predetermined period of time when there is a sudden opening of the throttle valve.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing is a simplified view of an internal combustion engine having an intake system and exhaust gas manifold system.

DESCRIPTION OF THE PREFERRED EMBODIMENT

The drawing, in simplified form, shows an internal combustion engine 1 having an intake system 2 and an exhaust gas manifold system 3. An exhaust gas recirculation line 4 leads from the exhaust gas manifold system 3 to the intake tube 2 downstream of a throttle valve 5 of the intake system. In the exhaust gas recirculation line 4, or as shown at the mouth thereof into the intake tube 2, an exhaust gas recirculation (EGR) valve 6 is provided, the valve closing member 7 of which cooperates with the mouth of the exhaust gas recirculation line 4 acting as a valve seat. The valve closing member 7 is joined to a movable wall 8 of a pneumatic control element 9, which in a conventional manner comprises a housing 10, in which a work chamber 11 is defined on one end, for instance by a diaphragm 8 acting as a movable wall. A restoring spring 12 which is supported at one end on the diaphragm 8 is disposed in the work chamber 11. The work chamber 11 communicates with a control pressure line 14, into which a flow line 15 discharges that leads to the atmosphere. A regulating valve 16 embodied as an electrofluid converter of the nozzle/impact plate type is disposed in the flow line 15. The control pressure line 14 also communicates with a connecting line 17 that discharges downstream of the throttle valve 5 in the intake tube 2. In the connecting line 17, remote from the intake tube 2, are a check valve 18 that opens toward the intake tube 2 and a throttle restriction 19 toward the control pressure line. Between the check valve 18 and the throttle restriction 19, the connecting line 17 leads through a negative pressure reservoir 20. A bypass line 21 leads from the connecting line 17 to the control pressure line 14, bypassing the throttle restriction 19. A bypass valve 22, also embodied as an electrofluid converter of the nozzle/impact plate type, is disposed in the bypass line 21 and can be triggered by an electronic control unit 23 that also controls the regulating valve 16. The electronic control unit 23 is supplied in a known manner with operating characteristics of the engine in the form of electrical signals, these being for instance an rpm signal n, a load signal $Q_K$ and, via a control signal line 24, an air flow rate signal from an air flow rate meter 25 disposed in the intake system 2.

The design of the regulating valve 16 and the bypass valve 22 is known per se, for instance from German Offenlegungsschrift DE-OS No. 31 09 560. Therefore a brief discussion of the function and operation of the electrofluid converters 16, 22 will suffice here. The electrofluid converters 16, 22 each include a rocker 26, which is acted upon electromagnetically, by means of a coil 27, with a variable deflection movment, so that each rocker undergoes a certain deflection about a pivot shaft 29. A nozzle 30 in the regulating valve 16 leads to a connection 36 to the atmosphere, embodying one end of the flow line 15 and communicating with the outside air. In the bypass valve 22, the nozzle 30 communicates with the side of the bypass line 21 that leads to the control pressure line 14. The nozzle 30 can be closed to a variable extent by an end of the rocker 26 which serves as an impact plate 31, so that depending on the extent to which this nozzle is open, in the regulating valve 16, a variable amount of air can flow from atmosphere via the nozzle 30 into an interior chamber 32 of the regulating valve 16; from this chamber 32, the flow line 15 leads on to the control pressure line 14. In the case of the bypass valve 22, the interior chamber 32 communicates with the part of the bypass line 21 which leads to the connecting line 17 which is disposed between the check valve 18 and the throttle restriction 19, and also communicates via the nozzle 30 with the part of the bypass line 21 leading to the control pressure line 14. The rocker 26 in each case acts counter to a countering spring 33. Via yokes 34 and associated poles, a permanent magnetic field generated by a permanent magnet acts upon the rocker 26, effecting a basic moment at the rocker. At a constant deflection moment engaging the rocker 26 of the regulating valve 16 and of the bypass valve 22, a pressure drop is generated between each nozzle 30 and the impact plate 31, this pressure drop being large enough that in the case of the regulating valve 16, a constant pressure difference, dependent on the deflection moment, between the outside air pressure and the pressure in the flow line 15 and thus in the work chamber 11 is established, and in the case of the bypass valve 22 a constant pressure difference, dependent on the deflection moment, between the pressure in the control pressure line 14, and thus in the work chamber 11, and the pressure in the intake tube 2 downstream of the throttle valve 5 or in the reservoir 20 is established. Thus, on the basis of the spring forces and/or magnetic forces exerted, the electrofluid nozzle/impact plate converters of the regulating valve 16 and bypass valve 22 regulate a predetermined desired pressure difference, which is dictated by the control signal of the electronic control unit 23. This is because the rocker 26 is acted upon by both the air pressure in the interior chamber 32 and the pressure in the work chamber 11, and so these pressures, together with the restoring spring forces and/or magnetic forces, lead to an equilibrium of forces. By means of the electrofluid converters 16, 22, a control pressure in the work chamber 11 can thus be regulated with great accuracy, as a function of the control current sent through the electronic control unit 23, and thus the exhaust gas recirculation rate effected by the EGR valve 6 can be controlled very accurately. This pressure difference, in the case of the regulating valve 16, is between atmospheric pressure and the pressure in the work chamber 11; particularly during idling and at low partial load of the engine 1, this pressure difference is unaffected by changes in the atmospheric pressure or in the pressure in the connecting line 17. In the case of the bypass valve 22, the pressure difference is between the pressure in the work chamber 11 and the pressure in the reservoir 20 or in the intake tube 2 downstream of the throttle valve 5. Downstream of the regulating valve 16, the flow line 15 has a bypass connection 37 leading to the atmosphere, with a flow throttle restriction 38.

The pressure difference prevailing between the intake tube 2 and the atmosphere connection 37 is divided, when the bypass valve 22 is closed, by the throttle restriction 19 and the regulating valve 16 functioning as a differential pressure regulator, to which the flow throttle restriction 38 is connected in parallel. The check valve 18 and the negative pressure reservoir 20 have the task, for a predetermined period, i.e., until the negative pressure reservoir is filled, of assuring a desired triggering of the EGR valve 6 in the opening direction, whenever the throttle valve 5 in the intake line 2 is suddenly opened. In this case, the pressure downstream of the throttle valve 5 in the intake tube 2 rises virtually to atmospheric pressure, and the check valve 18 then closes. The pressure divider, comprising the throttle restriction 19 and the regulating valve 16, can now continue operation and trigger the EGR valve 6 until the negative pressure reservoir 20 is filled. If the throttle valve 5 is again closed, then the pressure in the intake tube 2 drops, as does the pressure at the check valve 18, on its side remote from the negative pressure reservoir 20, and the check valve 18 opens, and so the negative pressure reservoir 20 empties once again. At the same time as the throttle valve 5 opens, the bypass valve 22 can be opened, so that via the bypass line 21 a negative pressure is very rapidly established in the work chamber 11 and the EGR valve 6 can be opened. The opening duration of the bypass valve 22 can be limited by a timing element, which is for instance provided in the electronic control unit 23. One possible example of a control signal for the bypass valve 22 is a rapid increase in the control current of the regulating valve 16, whereupon the impact plate 31 closes the nozzle 30 virtually completely. The disposition of the bypass line 21 having the bypass valve 22 has the advantage that the throttle restriction 19 can be provided with a very small cross section. As a result, when needed, the pressure in the work chamber 11 can be changed very rapidly in accordance with engine operating characteristics, and the EGR valve 6 can be moved very quickly. By embodying the regulating valve 16 and bypass valve 22 identically as electrofluid converters, identical adjusting speeds in both working directions are attained for the penumatic control element 9.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for controlling a quantity of exhaust gas recirculated from an exhaust system of an internal combustion engine to an intake system including an intake tube, an exhaust gas recirculation line connected from said exhaust system to said intake tube including an exhaust gas recirculation valve, a pneumatically operating final control element provided with a movable part connected to a valve closing member of said exhaust gas recirculation (EGR) valve, said final control element including a work chamber, said work chamber defined on one side by said movable part, and a further part arranged to communicate via a connecting line (17) having a first throttle restriction with said intake tube downstream of a throttle valve in said intake tube and via a first valve assembly having at least one pressure source, said valve assembly being further controllable by control signals of an electronic control unit in accordance with operating variables of said engine, said first valve assembly further including a first electrofluid converter of a nozzle/bounce plate type, which is located in a flow line adapted to communicate with atmospheric pressure via a throttle control and with said work chamber, and a bypass line connected to said connecting line (17) which bypasses said first throttle restriction (19) and which leads from the connecting line (17) to the work chamber (11), a second valve assembly including a second electrofluid converter connected in said bypass line (21) and controllable by said electronic control unit (23) for controlling fluid flow in said bypass line to said work chamber, whereby control signals of said electronic control unit regulate a pressure difference associated with said control signals between said atmospheric pressure and pressure in said work chamber.

2. An apparatus as defined by claim 1, which includes a one way check valve (18) in said connecting line which opens in a direction toward said intake tube (2) and a negative pressure reservoir (20) in said connecting line (17) between said check valve (18) and said first throttle restriction (19).

3. An apparatus as defined by claim 2, in which said second valve assembly (22) is openable for a predetermined duration, whenever said throttle valve (5) is moved into a position that opens said intake tube (2) for fluid flow.

4. An apparatus as defined in claim 1, wherein said exhaust gas recirculation line forms a mouth with said intake tube and said mouth forms a valve seat for said valve closing member connected to said movable part of said final control element.

* * * * *